US012736218B2

(12) United States Patent
Taylor et al.

(10) Patent No.: US 12,736,218 B2
(45) Date of Patent: Sep. 15, 2026

(54) COMPACT LOW EMISSIONS BURNER NOZZLE USING ADDITIVE MANUFACTURING

(71) Applicant: Honeywell International Inc., Charlotte, NC (US)

(72) Inventors: Curtis L. Taylor, Paradise Valley, AZ (US); Andrew Collier, Arlington Heights, IL (US); Wyatt Robert Francis Culler, Berne, IN (US); Heinz-Peter Gitzinger, Neuss (DE); Ceji Li, Bolingbrook, IL (US); Abderahman Rabhiou, Brussels (BE)

(73) Assignee: Honeywell International Inc., Charlotte, NC (US)

( * ) Notice: Subject to any disclaimer, the term of this patent is extended or adjusted under 35 U.S.C. 154(b) by 280 days.

(21) Appl. No.: 18/388,267

(22) Filed: Nov. 9, 2023

(65) Prior Publication Data

US 2025/0155121 A1 May 15, 2025

(51) Int. Cl.
*F23D 11/38* (2006.01)
*F23D 11/40* (2006.01)

(52) U.S. Cl.
CPC ..... *F23D 11/38* (2013.01); *F23D 11/406* (2013.01)

(58) Field of Classification Search
CPC ..... F23D 11/38; F23D 11/406; F23D 11/102; F23D 11/12; F23D 17/002; F23D 14/22; F23D 14/48; F23D 14/58; F23D 14/64; F23D 14/62; F23D 2207/00; F23D 2900/00008; F23D 6/047; B05B 7/0475; B05B 7/0491
See application file for complete search history.

(56) References Cited

U.S. PATENT DOCUMENTS 4,505,666 A 3/1985 Martin et al.
5,275,554 A * 1/1994 Faulkner ..... F23C 9/00 431/9
10,344,971 B2 * 7/2019 Miller ..... F23D 14/58
(Continued)

FOREIGN PATENT DOCUMENTS

CA 2653890 C 8/2009
CN 113310049 B 8/2023
(Continued)

OTHER PUBLICATIONS

Erwin Platvoet and Charles Baukal, P.C., "Process Burners 101", CEP, Aug. 2013, www.aiche.org/cep.
(Continued)

*Primary Examiner* — Christopher R Dandridge
(74) *Attorney, Agent, or Firm* — Ingrassia Fisher & Lorenz LLP

(57) ABSTRACT

A burner nozzle and a method of operating the burner nozzle can include a main air/fuel port located centrally within the burner nozzle, and a group of staged gas fuel ports that surrounds the main air-fuel port and which can direct fuel to an established flame zone downstream from the burner nozzle. Furthermore, a trapped vortex chamber can be formed in a wall of the main air/fuel port and can communicate with a group of primary gas ports in a fuel circuit, such that the trapped vortex chamber facilitates flame stability with respect to a flame produced by the burner nozzle.

9 Claims, 7 Drawing Sheets

(56) References Cited

U.S. PATENT DOCUMENTS

| | | | | |
|---|---|---|---|---|
| 11,747,013 | B2 * | 9/2023 | Carroll | F23D 14/64 431/9 |
| 2021/0310652 | A1 | 10/2021 | Anderson | |

FOREIGN PATENT DOCUMENTS

| | | | |
|---|---|---|---|
| EP | 0592081 | B1 | 7/1999 |
| EP | 1867923 | B1 | 11/2011 |
| WO | 2015072629 | A1 | 5/2015 |

OTHER PUBLICATIONS

"Boiler Burners", International Combustion Equipment S.r.l., www.it-ice.com.

* cited by examiner

COMPACT LOW EMISSIONS BURNER NOZZLE USING ADDITIVE MANUFACTURING

TECHNICAL FIELD

Embodiments are generally related to industrial burner technologies. Embodiments further relate to low emissions burners that can be used in industrial fuel applications. Embodiments also relate to the field of additive manufacturing (AM).

BACKGROUND

Oxides of nitrogen in the form of NO and NO2 (NOx) are generated by the burning of fossil fuels. Along with NOx from vehicles, NOx from fossil fuel fired industrial and commercial heating equipment (e.g., furnaces, ovens, etc.) is a major contributor to poor air quality and smog. Many industrial burner designs exist to address this issue, however, most if not all, are complex fabricated assemblies.

These assemblies require wall or floor mounting space to create the required air and fuel mixing geometries to accomplish low NOx emissions. What is needed, is a burner design that can leverage additive manufacturing technology, to reduce the size and cost of low NOx burner technology by creating the full-size low emissions burner geometry in a compact single nozzle.

BRIEF SUMMARY

The following summary is provided to facilitate an understanding of some of the features of the disclosed embodiments and is not intended to be a full description. A full appreciation of the various aspects of the embodiments disclosed herein can be gained by taking the specification, claims, drawings, and abstract as a whole.

It is, therefore, one aspect of the embodiments to provide for improved burner technologies capable of being used in industrial and other applications.

It is another aspect of the embodiments to provide for an improved burner nozzle and a method of operating the burner nozzle.

It is yet another aspect of the embodiments to provide for an improved burner nozzle that can leverage additive manufacturing technology, to reduce the size and cost of low NOx burner technology by creating a full-size low emissions burner geometry in a compact single nozzle.

The aforementioned aspects and other objectives can now be achieved as described herein. In an embodiment, a burner nozzle can include a main air/fuel port located centrally within the burner nozzle, a plurality of staged gas fuel ports that surrounds the main air-fuel port and which can direct fuel to an established flame zone downstream from the burner nozzle, and a trapped vortex chamber formed in a wall of the main air/fuel port and which can communicate with a plurality of primary gas ports in a fuel circuit, wherein the trapped vortex chamber facilitates flame stability with respect to a flame produced by the burner nozzle.

In an embodiment, the plurality of locations can include a primary zone wherein primary fuel can be mixed with air prior to ignition inside the trapped vortex chamber of the burner nozzle.

In an embodiment, the plurality of locations can include a location wherein ignition fuel aids ignition and the flame holding in the trapped vortex chamber.

In an embodiment, the plurality of locations can include a location where staged fuel can be injected downstream of the fuel ignited in a primary zone.

In an embodiment, the plurality of locations can include a primary zone wherein primary fuel is mixed with air prior to ignition inside the trapped vortex chamber of the burner nozzle, a location wherein ignition fuel aids ignition and the flame holding in the trapped vortex chamber, and a location where staged fuel can be injected downstream of the fuel ignited in the primary zone.

In an embodiment, after ignition inside the trapped vortex chamber of the burner nozzle the flame is stable and self-sustaining.

In an embodiment, each of the plurality of staged gas fuel ports can be sized to split a percentage of the fuel and direct the fuel into the staged flame zone downstream of a primary flame.

In an embodiment, a burner nozzle can include a plurality of staged gas fuel ports that surrounds a main air-fuel port and which directs fuel to an established flame zone downstream from the burner nozzle, and a trapped vortex chamber formed in the main air/fuel port and which can communicate with a plurality of primary gas ports in a fuel circuit, wherein the trapped vortex chamber facilitates flame stability with respect to a flame produced by the burner nozzle.

In an embodiment, a method of operating a burner nozzle, can involve: directing fuel with a plurality of staged gas fuel ports that surrounds a main air-fuel port to an established flame zone downstream from a burner nozzle, wherein the main air-fuel port is located centrally within the burner nozzle; an facilitating with a trapped vortex chamber, flame stability with respect to a flame produced by the burner nozzle, wherein the trapped vortex chamber is formed in a wall of the main air/fuel port and which communicates with a plurality of primary gas ports in a fuel circuit in the burner nozzle.

An embodiment of the method can involve mixing primary fuel with air in a primary zone among the plurality of locations, wherein the primary fuel is mixed with the air prior to ignition inside the trapped vortex chamber of the burner nozzle.

In an embodiment of the method, the plurality of locations can include a location wherein ignition fuel aids ignition and the flame holding in the trapped vortex chamber.

In an embodiment of the method, the plurality of locations can include a location where staged fuel is injected downstream of the fuel ignited in a primary zone.

In an embodiment of the method, each of the plurality of staged gas fuel ports can be sized to split a percentage of the fuel and direct the fuel into the staged flame zone downstream of a primary flame.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

In the drawings described and illustrated herein, identical or similar parts and elements are generally indicated by identical reference numerals.

DETAILED DESCRIPTION

Figure 1A:
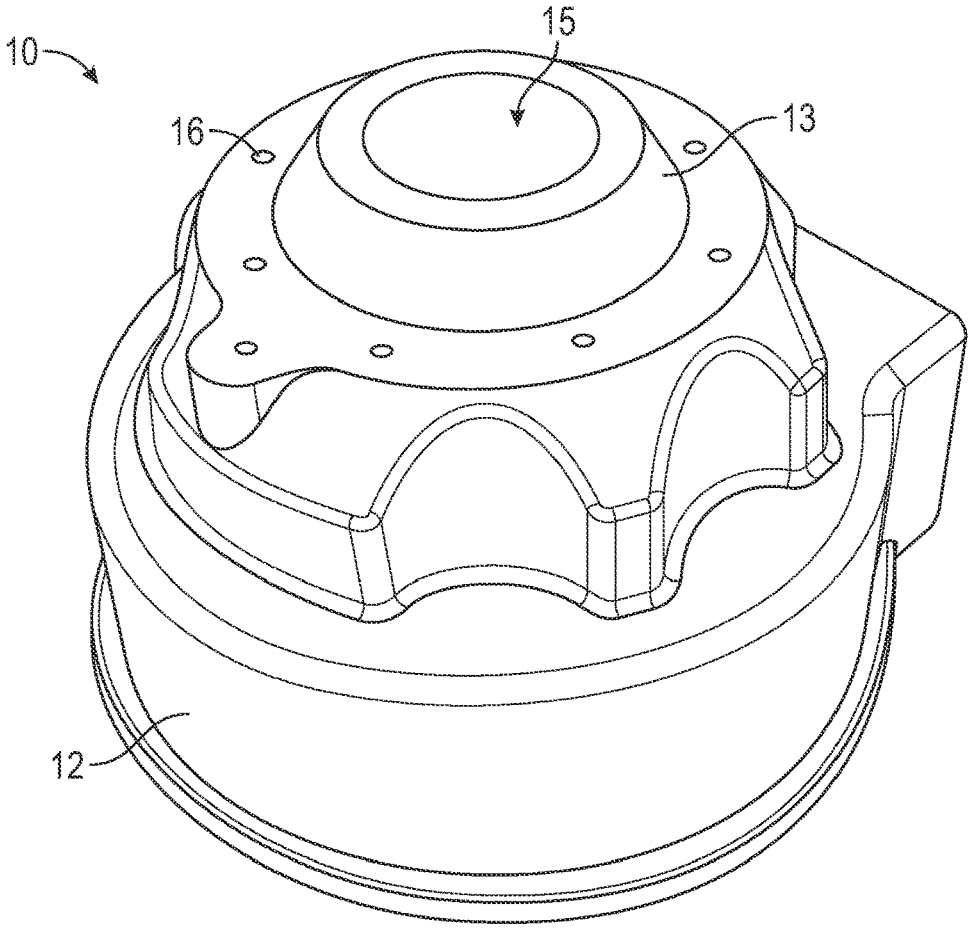
FIG. 1A illustrates a pictorial view of a burner nozzle, which can be implemented in accordance with an embodiment.

The particular values and configurations discussed in these non-limiting examples can be varied and are cited merely to illustrate one or more embodiments and are not intended to limit the scope thereof.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other issues, subject matter may be embodied as methods, devices, components, or systems. Accordingly, embodiments may, for example, take the form of hardware, software, firmware, or a combination thereof. The following detailed description is, therefore, not intended to be interpreted in a limiting sense.

Throughout the specification and claims, terms may have nuanced meanings suggested or implied in context beyond an explicitly stated meaning. Likewise, phrases such as "in one embodiment" or "in an example embodiment" and variations thereof as utilized herein may not necessarily refer to the same embodiment and the phrase "in another embodiment" or "in another example embodiment" and variations thereof as utilized herein may or may not necessarily refer to a different embodiment. It is intended, for example, that claimed subject matter include combinations of example embodiments in whole or in part.

In general, terminology may be understood, at least in part, from usage in context. For example, terms such as "and," "or," or "and/or" as used herein may include a variety of meanings that may depend, at least in part, upon the context in which such terms are used. Generally, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. Similarly, terms such as "a," "an," or "the", again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

The embodiments provide for a significant improvement in reducing the size and geometry limitations of various low emission combustion techniques used by industrial and commercial burner companies. In addition, the embodiments can allow for the creation of mixing geometries that may be difficult, if not impossible, to create using conventional machining and fabrication processes. Additive manufacturing (AM) allows us to apply all of these low emissions techniques in a single one-piece nozzle. This was not possible prior to the development of AM technology. The embodiments can also utilize a unique trapped vortex flame stabilizing method, which can eliminate the need for physical devices such as cones and swirlers, to be placed into the fuel-air stream to provide flame stabilization. This can provide for reduced pressure drop through the burner and allows higher thermal inputs (BTU/hr or kw/hr) in a smaller device.

The term additive manufacturing or AM as utilized herein can relate to a manufacturing process that can build objects layer by layer, adding material only where it is needed, as opposed to traditional subtractive manufacturing where material is removed from a solid block. This technology has gained popularity due to its ability to create complex and customized components with precision.

To create a burner nozzle using additive manufacturing for both industrial and non-industrial applications, the process can begin with creating a 3D model of the burner nozzle using computer-aided design (CAD) software. This digital model is essential as it can guide a 3D printer on how to construct the physical object layer by layer. Appropriate material should be selected for the nozzle based on the specific requirements of the application. Common materials for industrial applications may include heat-resistant alloys or ceramics, while non-industrial applications might use plastics or metals. The material is typically in the form of a powder, filament, or liquid resin, depending on the type of 3D printing technology.

There are various AM technologies available, such as Fused Deposition Modeling (FDM), Stereolithography (SLA), Selective Laser Sintering (SLS), and others. The choice of technology depends on factors like material, required precision, and post-processing needs.

After printing, post-processing steps may be required to improve the surface finish, accuracy, and functionality. This can include sanding, painting, or heat treatment, depending on the material and application. It is crucial to inspect the 3D-printed nozzle for any defects or inaccuracies to ensure it meets the required standards for both industrial and non-industrial use. If necessary, the 3D-printed burner nozzle can be assembled with other components of the system it belongs to.

Additive manufacturing offers several advantages, including design flexibility, reduced material waste, and the ability to create complex geometries. This makes it well-suited for both industrial and non-industrial applications. Industrial burners often require custom designs for specific processes, and 3D printing can deliver those designs efficiently. For non-industrial applications, 3D printing allows for cost-effective, small-scale production of burner nozzles with customized features, making it a versatile manufacturing technique for various contexts.

Figure 1B:
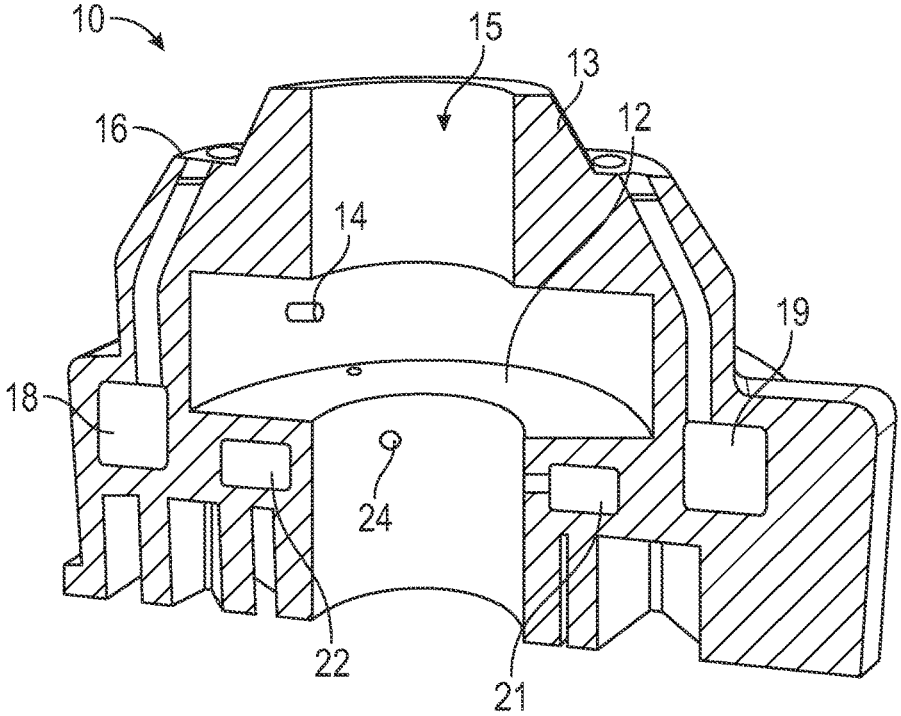
FIG. 1B illustrates a cutaway sectional circular view of the burner nozzle shown in FIG. 1A in accordance with an embodiment.

FIG. 1A illustrates a pictorial view of a burner nozzle 10, which can be implemented in accordance with an embodiment. FIG. 1B illustrates a cutaway view of the burner nozzle 10 shown in FIG. 1A in accordance with an embodiment. The burner nozzle 10 can include a vortex chamber 14 (also referred to as a vortex chamber) and a stabilization circuit composed of a staged fuel circuit including a port 16 and a staged fuel manifold 18, which is formed into the burner nozzle 10. The vortex chamber 14 can also be formed within the burner nozzle 10. Note that the port 16 is an example of a staged gas fuel port. A group of such staged gas fuel ports can surround the main air-fuel port 15 and can direct fuel to locations downstream of the burner nozzle 10.

A circular chamber base 12 can be located at the bottom of the vortex chamber 14. A primary fuel circuit can include port 24. In addition, a primary fuel manifold 22 can be formed into the burner nozzle 10. A main air/fuel port 15 is located centrally within the burner nozzle 10 within a nozzle portion 13. That is, the air/fuel primary port 15 can be formed within the nozzle portion 13. The burner nozzle 10 can include or may be configured with the circular chamber 12. Fuel manifolds 19 and 21 are also included with burner nozzle 10. The fuel manifold 19 is a staged fuel manifold and the fuel manifold 21 is a primary fuel manifold. It should be appreciated that in some of the drawings presented herein, different reference numerals may refer to the same feature, particularly in drawings that depict a circular feature in a sectional view.

Note that the terms "burner nozzle" and "nozzle" as utilized herein can be utilized herein to refer to the same feature. For example, reference to a "nozzle" herein may refer to "burner nozzle". As will be discussed in more detail below, the burner nozzle 10 can be produced by additive manufacturing (AM) as discussed above to create complex flow passages and port geometries for both fuel and air. The burner nozzle 10 can be connected to sources of combustion air and fuel gas using methods such as piping, ducting, air housings, etc.

Combustion air can pass through the center of the burner nozzle 10. From a single inlet connection, fuel gas distributes through the burner nozzle 10 by means of internal passages that can be designed to carry the fuel gas in adequate volumes. Ports throughout the burner nozzle 10, that communicate into these fuel gas passages, can inject this fuel gas at an exact volume, position and angle required to create a stable, low NOx flame, after ignition by a pilot or igniter.

After ignition, the flame is stable and self-sustaining. The fuel ports within the burner nozzle 10 can be located in such a way, that the NOx reducing effects of staged fuel and lean primary stage combustion, can be realized in a very reduced space compared to existing technologies (see attached examples). The burner nozzle 10 can utilize the unique trapped vortex chamber 14 formed in the wall of a main air/fuel port of the burner nozzle 10, which provides flame stability without the use of a bluff body, cone, swirler or other means of sustaining a flame.

A burner design can require a stabilizing device to be placed into the fuel-air stream. A stabilizing device can function by creating pressure drop, which can reduce the output of the burner when compared by thermal capacity (BTU or kw) per burner cross sectional flow area. The fuel ports can be sized to direct a percentage of the total nozzle fuel flow and direct it to three locations: a primary gas mixed with air prior to ignition, ignition gas to aid ignition and flame holding in the trapped vortex, and staged gas downstream of the ignited primary fuel. This splitting of the fuel gas can create the effect of lean combustion in the primary zone, with flame beginning at the trapped vortex chamber and extending out through the main port and downstream of the nozzle, ignition gas in the trapped vortex (if required) and staged combustion downstream of the primary flame zone.

The percentage of gas delivered to each of the three zones can vary or be eliminated to produce combustion effects that may be optimal for the fired application. Note that in one experimental embodiment for low excess air heaters and furnaces, the percentage of primary, ignition and staged fuel was respectively: 29%/1%/70%. Those skilled in the art will recognize that a wide range of combinations for the fuel percentages, can be designed and executed to tailor the nozzle for various industrial ovens, furnaces, boilers, etc. The amount of fuel gas injected in the trapped vortex chamber to stabilize combustion, can vary from, for example, 0-20% depending on the specific fuel characteristics.

The burner nozzle 10 along with the various embodiments described herein can be manufactured using AM technology. The burner nozzle 10 can be scaled to larger sizes for use as a single nozzle burner, or smaller individual nozzles can be incorporated into a multi-nozzle assembly such as the multiport nozzle plates shown and described herein with respect to FIG. 5, FIG. 8, and FIG. 11A to FIG. 11E.

Figure 2A:
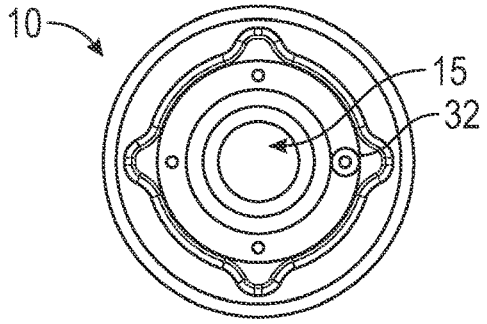
FIG. 2A illustrates a top view of the burner nozzle in accordance with an embodiment.

FIG. 2A illustrates a top view of the burner nozzle 10 shown in FIGS. 1A to FIG. 1B in accordance with an embodiment. The burner nozzle 10 shown in FIGS. 2A to FIG. 2E is slightly different from the burner nozzle 10 embodiment shown in FIGS. 1A to FIG. 1B. For example, a staged fuel gas port 16 is shown in FIG. 1A and FIG. 1B among a group of staged fuel gas ports. FIG. 2A shows a staged fuel gas port 32 among a group of four staged fuel gas ports surrounding the main air/fuel port 15. The embodiment shown in FIG. 1A and FIG. 1B shows more than four staged fuel gas ports, while the embodiment shown in FIG. 2A shows a group of four staged ports including port 32. The variation in the drawings herein is provided to demonstrate different embodiments of the burner nozzle 10 such differences in the number of staged gas fuel ports used in varying embodiments.

Figure 2B:
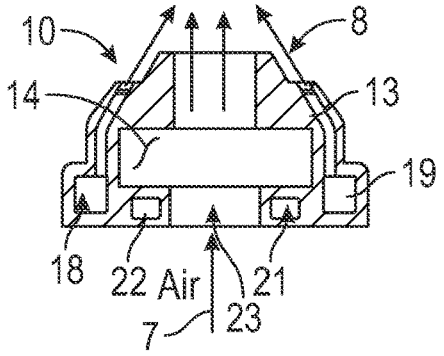
FIG. 2B illustrates a side circular sectional D-D view of the burner nozzle in accordance with an embodiment.

FIG. 2B illustrates a side sectional D-D view of the burner nozzle 10 in accordance with an embodiment. In FIG. 2B, arrow 8 indicates the flow of staged fuel gas and vortex chamber 14 is shown as a trapped vortex flame stabilizing chamber located centrally within the burner nozzle 10. Furthermore, arrow 7 indicates the flow of air into the burner nozzle 10 to a primary premixing port 23. Note that in FIG. 2B, the primary fuel gas manifold 21 is shown.

Figure 2E:
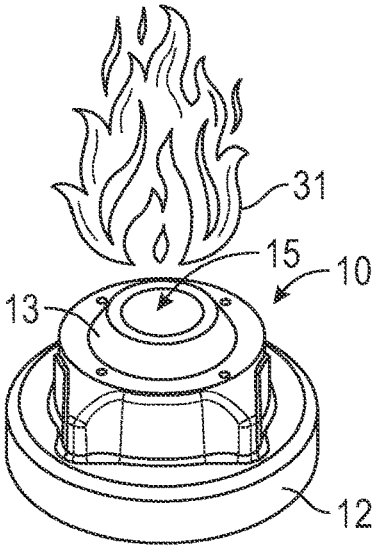
FIG. 2E illustrates a perspective view of the burner nozzle with respect to a flame in accordance with an embodiment.
Figure 2C:
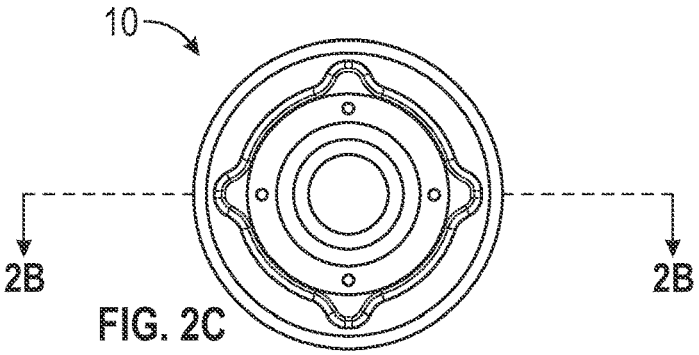
FIG. 2C illustrates a top D-D view of the burner nozzle in accordance with an embodiment.
Figure 2D:
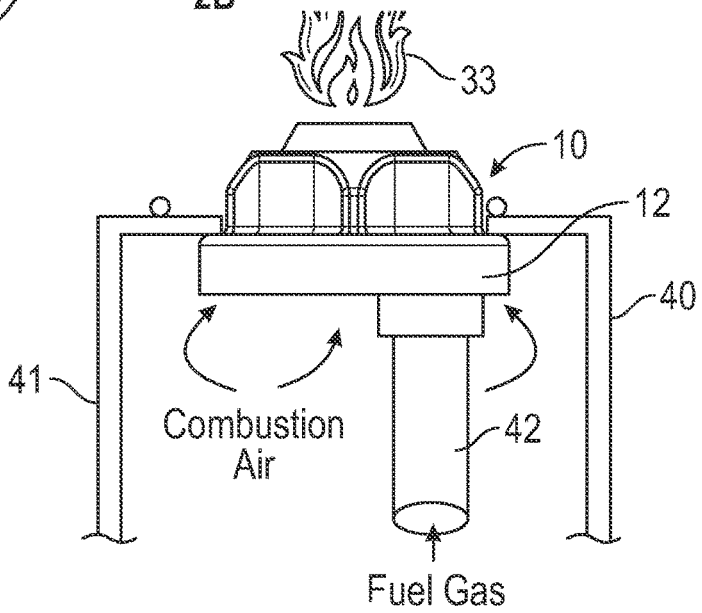
FIG. 2D illustrates a side view of the burner nozzle in a mounted position, in accordance with an embodiment.

FIG. 2C illustrates a top view of the burner nozzle 10 in accordance with an embodiment. FIG. 2C also shows a flame front 33 with respect to the burner nozzle 10. FIG. 2D illustrates a side view of the burner nozzle 10 in a mounted position with respect to an air tube composed of an air tube section 40 and an air tube section 41, in accordance with an embodiment. That is, an air tube can be included which includes the air tube sections 40 and 41. A fuel gas tube 42 can connect to the base 12 of the burner nozzle 10 in the embodiment shown in FIG. 2D. FIG. 2E illustrates a perspective view of the burner nozzle 10 with respect to a flame 31 in accordance with an embodiment.

Figure 3:
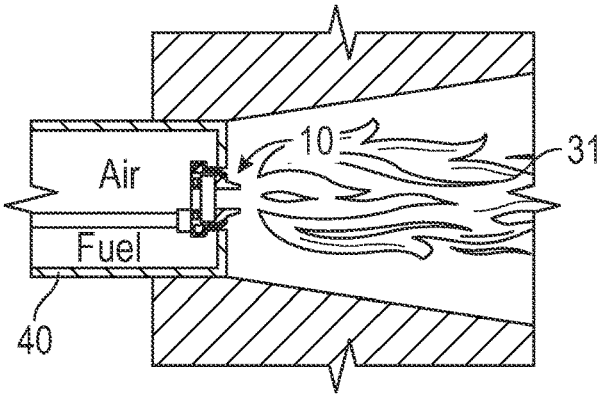
FIG. 3 illustrates a schematic diagram of a single nozzle in burner implementation in accordance with an embodiment.
Figure 4:
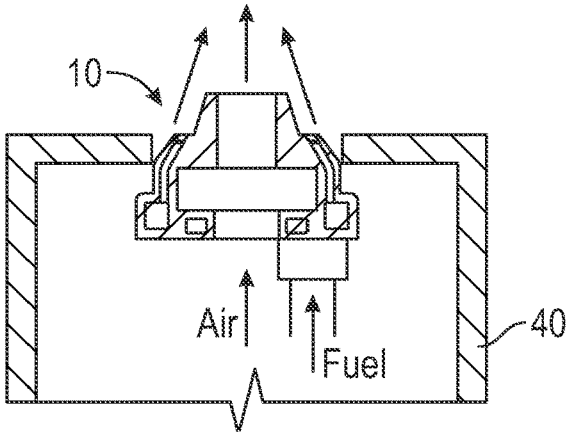
FIG. 4 illustrates a schematic diagram of a single burner nozzle recessed arrangement, in accordance with an embodiment.

FIG. 3 illustrates a schematic diagram of a single burner nozzle 10 implementation in accordance with an embodiment. FIG. 4 illustrates a schematic diagram of a single burner nozzle 10 recessed arrangement, in accordance with an embodiment.

Figure 5:
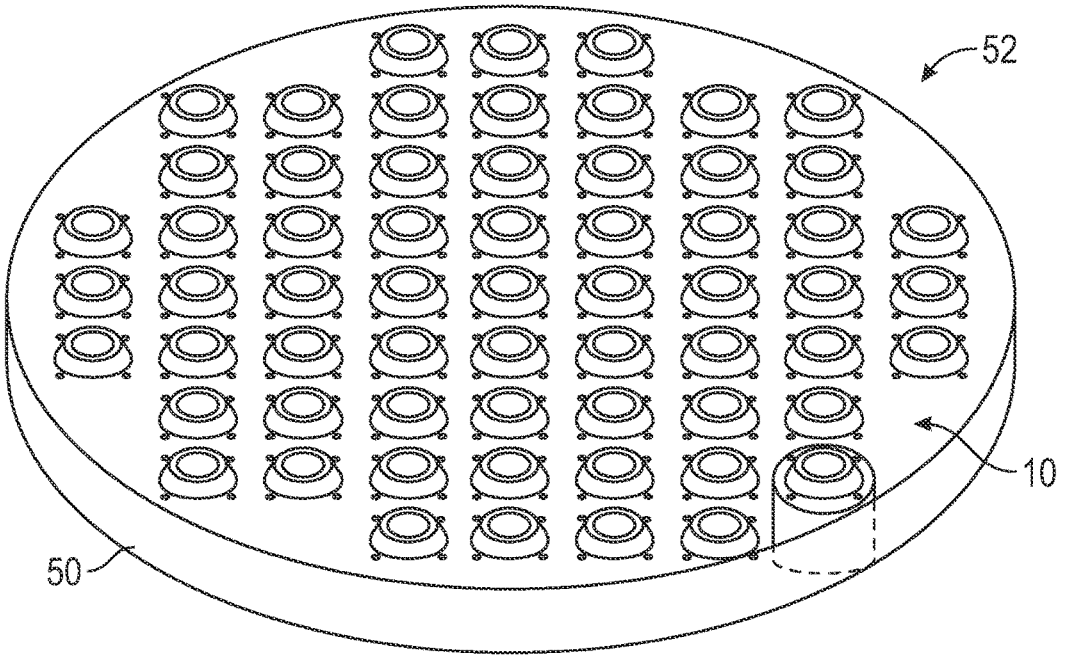
FIG. 5 illustrates a pictorial view of multiple nozzles in a plate arrangement, in accordance with embodiment.

FIG. 5 illustrates a pictorial view of a system 52 of multiple nozzles implemented in a multi-nozzle plate 50, in accordance with embodiment.

Figure 6:
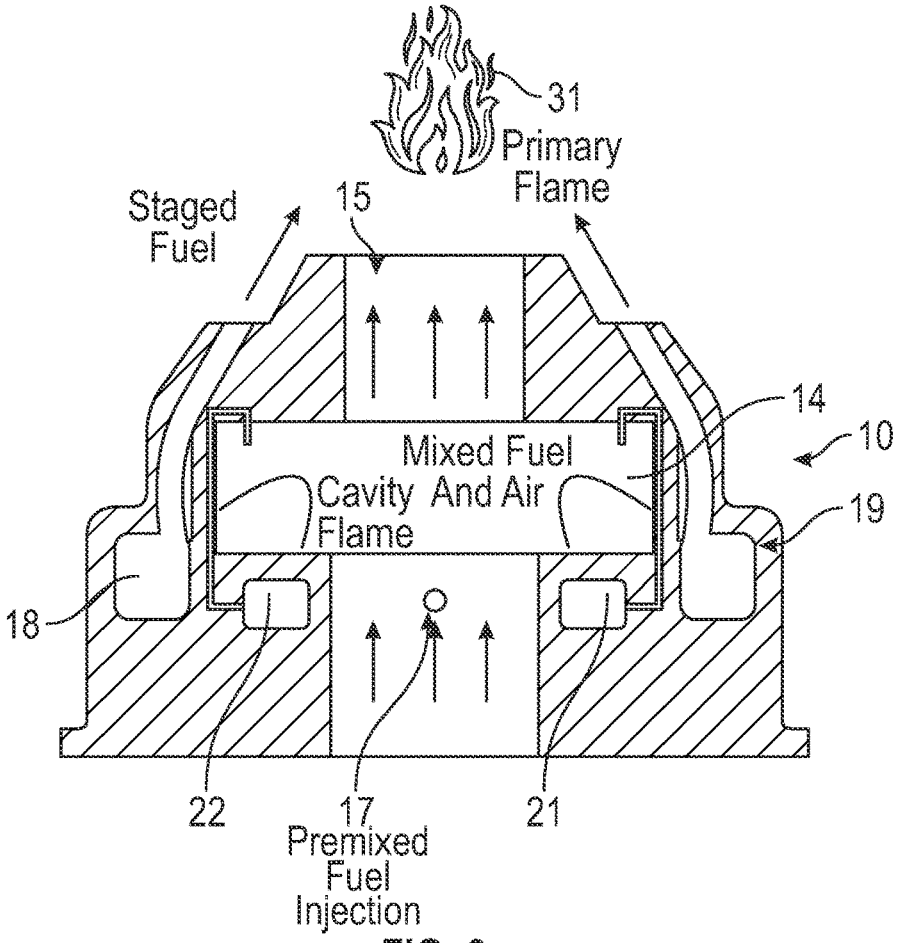
FIG. 6 illustrates a side cut-away circular sectional view of the burner nozzle in a primary ignition staged fuel arrangement in accordance with an embodiment.

FIG. 6 illustrates a side cut-away of the burner nozzle 10 implemented in a primary staged ignition fuel arrangement in accordance with an embodiment. As discussed previously, the burner nozzle 10 can be configured through AM technology. The burner nozzle 10 can include the main air/fuel port 15, a fuel injection port 17 and an internal fuel manifold composed of a circular formed primary fuel manifold comprising primary fuel gas manifold 21 and 22 (note that the reference numerals 21 and 22 refer to the same feature—the circular formed primary fuel manifold 21, 22). Staged fuel ports 18 and 19 can be located within the walls of the burner nozzle 10. Furthermore, a primary fuel port 17 (e.g., a fuel injection port) can inject fuel into the air stream to create a premix of fuel and air prior to ignition in the vortex chamber.

Figure 7:
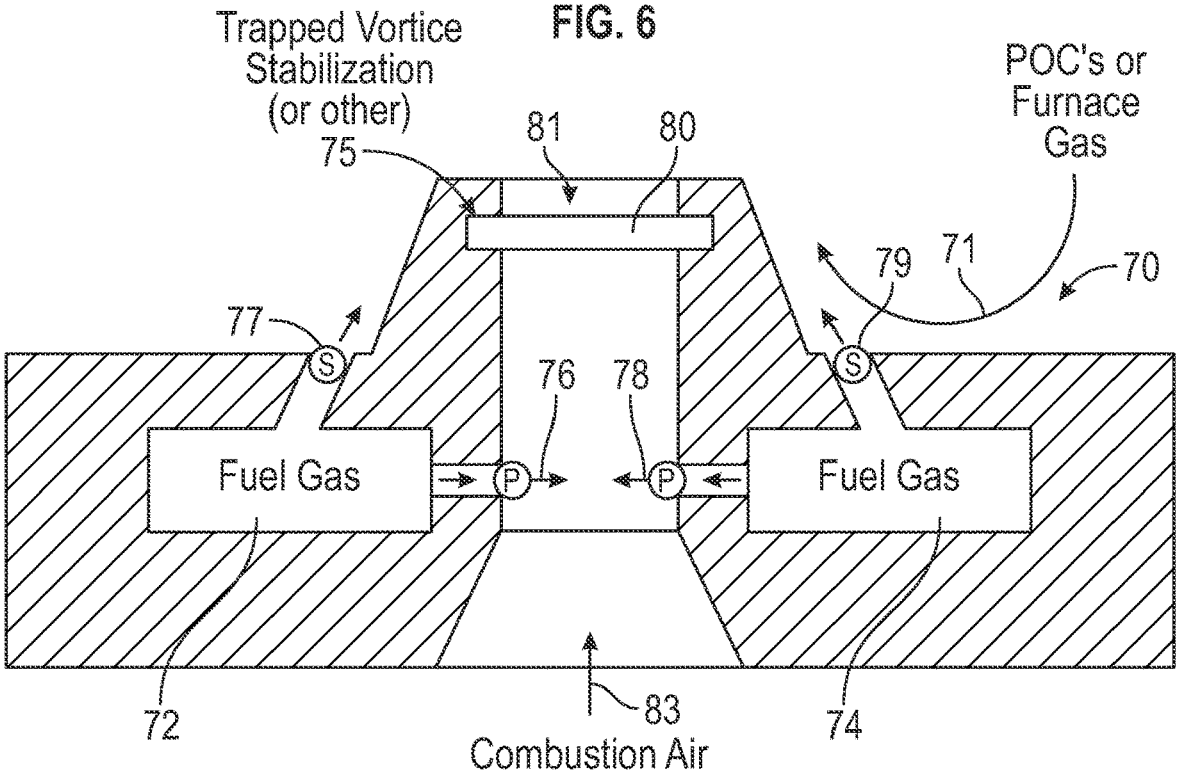
FIG. 7 illustrates a schematic diagram of a port detail view of a staged multi-port nozzle in accordance with an embodiment.

FIG. 7 illustrates a schematic diagram of the a side view of a staged fuel multiport nozzle 70, which can be implemented in accordance with an embodiment. Note that the staged fuel multiport nozzle 70 is an alternative version of the burner nozzle 10 discussed above. The staged fuel multiport nozzle 70 may be implemented via additive manufacturing and can include a trapped vertice stabilization feature 75 with respect to a chamber 80. A staged fuel ratio can be determined by the ratio of the areas of the primary (P) ports 76 and 78 and staged ports (S) 77 and 79. A fuel gas chamber 72 communicates with ports 76 and 77, and a fuel gas chamber 74 communicates with ports 78 and 79.

Note that in FIG. 7, a fuel gas manifold 72, 74 is shown (Note: reference numerals 72 and 74 can represent the same fuel gas manifold). Since the fuel pressure is the same in that circular manifold, the port areas for primary ports 76/78 and staged ports 77/79 determine the primary/staged fuel ratio. The ports 76/78 and ports 77/79 designate the primary and staged fuel ports. Note that although different reference numerals are shown in FIG. 7, some of these reference numerals are the same element or device because FIG. 7 is a cross-sectional view of a circular device. The same manifold (e.g., manifold 72, 74), for example, appears on both sides of the main air/fuel port.

The primary ports 76 can be opposed or offset to induce spin. The staged ports 77 can eject along the conical shape of a main primary port 81 to draw furnace gases into the base of the flame (e.g., such as the previously discussed flame 31). In some embodiments, staged air potential can be added between the main port(s) 81. The trapped vortex stabilization feature 75 (and/or other stabilization features) can be implemented with, for example, a V-shaped bar across the main port(s) 81. The design shown in FIG. 7 can use a port mix method for the primary main port 81 but could also use premixed (partial) gas where combustion air is shown, as indicated by arrow 83. In some embodiments, multiple fuel manifolds (e.g., such as manifold 21, shown in FIG. 6) can be used to allow for turndown expansion.

It should be appreciated that the configurations shown in FIG. 6 and FIG. 7 can create the same nozzle. Both FIGS. 6 and 7 include the following elements: main air/fuel port, primary fuel ports, staged fuel ports and trapped vortex flame stabilization chamber. The difference is in the fuel manifolds. For example, the primary fuel port 17 shown in FIG. 6 is analogous to the primary fuel port 76/78 shown in FIG. 7. Similarly, the fuel manifold 72/74 shown in FIG. 7 is analogous to the staged fuel ports 18/19 and 21/22 in FIG. 6.

FIG. 6 shows a configuration that splits the FIG. 7 fuel manifold 72/74 into primary and staged manifolds, whereas FIG. 7 shows a single fuel manifold for both the staged and primary gas. Either embodiment can function the same manner since the fuel pressure to primary and staged fuel manifolds would be the same in a typical installation. We are not separately controlling the fuel pressures to each manifold, since we use the fuel port sizes to accomplish the optimal low emissions primary/staged fuel ratio.

Figure 8:
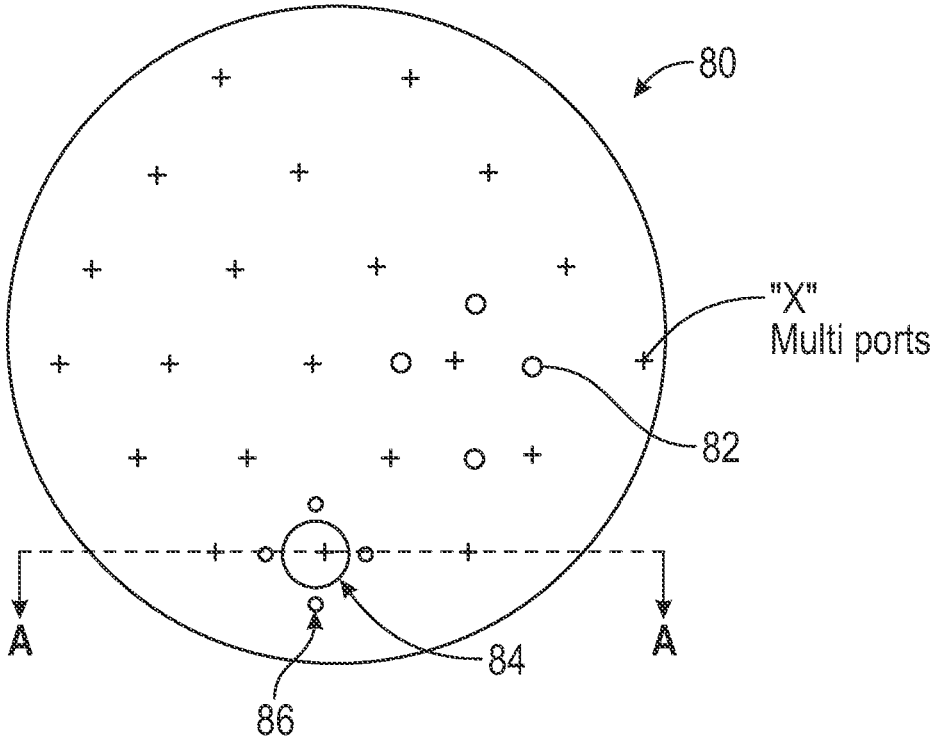
FIG. 8 illustrates a multiport burner nozzle arrangement in accordance with an embodiment.

FIG. 8 illustrates of a multiport burner nozzle plate 80 in accordance with an embodiment. The multiport burner nozzle plate 80 is a variation of the plate 52 shown in FIG. 5. The configuration shown in FIG. 8 includes "X" multiports, which may be implemented as mix or pre-mix ports in different embodiments. Additionally, a main primary port (port mix) 84 is shown along with a staged fuel port 86 (e.g., for raw gas). A staged air potential 82 is also shown in FIG. 8 (note that the "X" multiports shown are simply replications of the 84/86 reference numeral geometry for ease of explanation).

Figure 9:
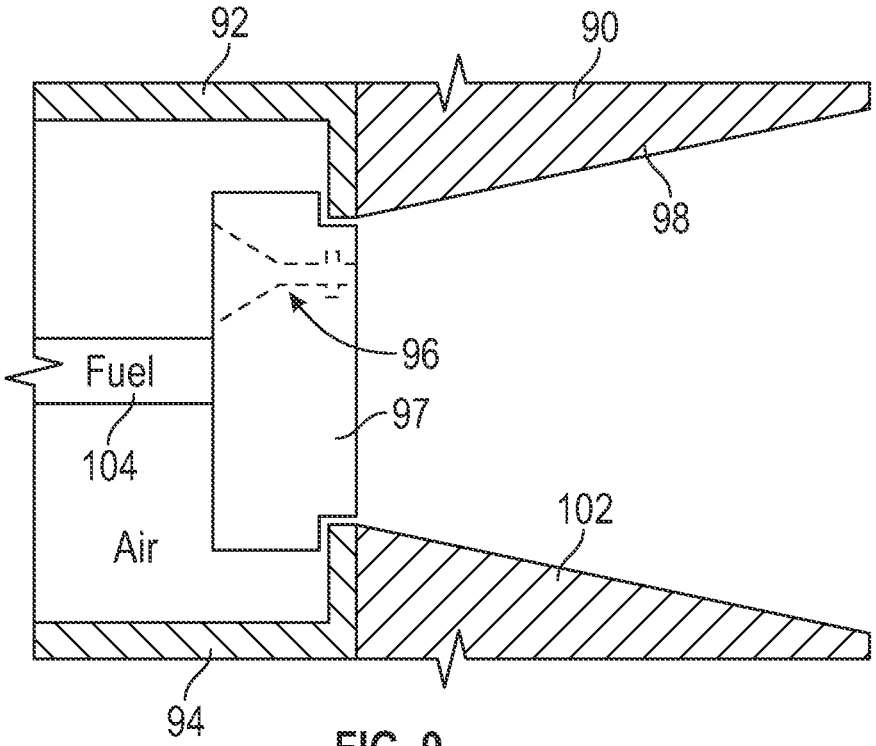
FIG. 9 illustrates a schematic diagram of a single center fuel feed system, which can be implemented in accordance with an embodiment.

FIG. 9 illustrates a schematic diagram of a single center fuel feed system 90, which can be implemented in accordance with an embodiment. The single center fuel feed system 90 can include an air tube that includes air tube section 92 and an air tube section 94, along with a fuel supply tube 104. The system 90 shown in FIG. 9 also includes a multi nozzle plate 97 (which is analogous to the nozzle plate 50 shown in FIG. 4). Also shown in FIG. 9 are discharge blocks 98 and 102 or sleeve shapes downstream of the air/fuel nozzle to protect the burner assembly. The discharge blocks 98 and 102 may contain the flame are not required for implementation of the embodiments. The discharge blocks 98 and 102 are presented herein for illustrative purposes only.

Figure 10:
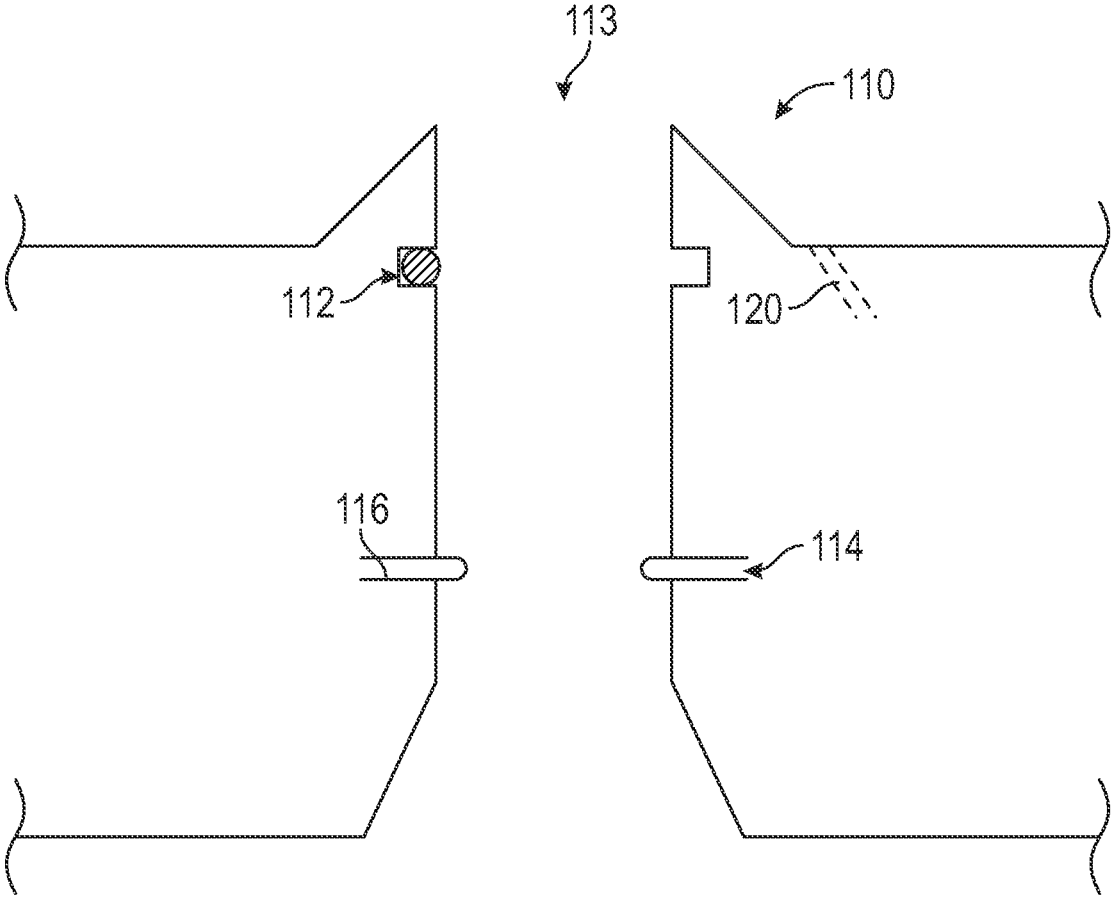
FIG. 10 illustrates a schematic diagram of a staged fuel port arrangement, which can be implemented in accordance with an embodiment.

FIG. 10 illustrates a schematic diagram of a staged fuel port arrangement 110 in accordance with an embodiment. The configuration shown in FIG. 10 can include two options for the staged fuel port arrangement 110. For example, one option (Option A) may involve the use of a tangential ignition port to inject gas into a vortex chamber such as the vortex chamber 75 depicted in FIG. 5 or the vortex chamber 14 shown in FIG. 2B and FIG. 6). Option A can involve a small percentage of ignition gas tangent to a vortex chamber. A second option (Option B) can involve drilling of main gas ports as indicated by the primary gas fuel ports 114 and 116. This can produce a fuel mix in the vortex chamber (e.g., such as vortex chamber 75 shown in FIG. 7).

Note that the primary gas fuel ports 114 and 116 shown in FIG. 10 are analogous to the ports 76 and 78 shown in FIG. 7 and also analogous to the primary fuel port 17 shown FIG. 6. The primary gas fuel ports 114 and 116 shown in FIG. 10 are also analogous to the ports 24 in FIG. 1B or the port 23 in FIG. 2B. FIG. 10 also depicts one port 10 among multiple staged ports. An analogous or similar feature also appears in FIG. 2A as port 32 and in FIGS. 1A and 1B as port 16.

Figure 11A:
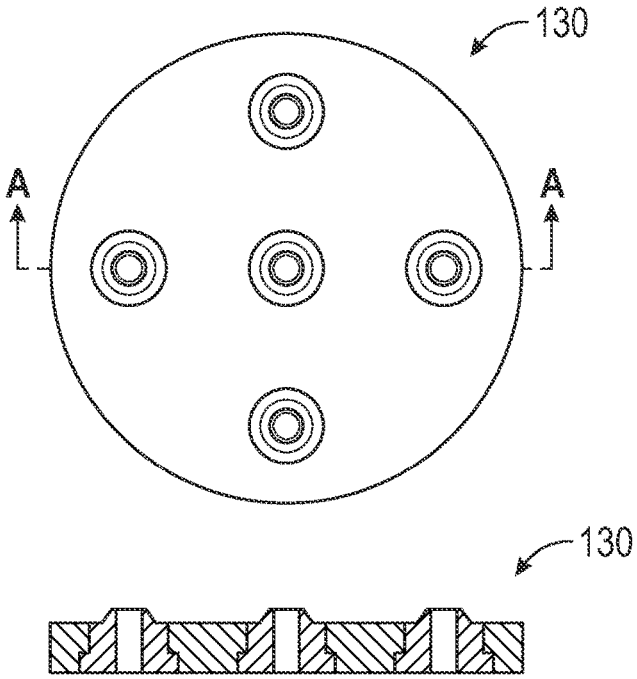
FIG. 11A illustrates a top view and a sectional A-A view of a multiport nozzle plate, which may be implemented in accordance with an embodiment.
Figure 11B:
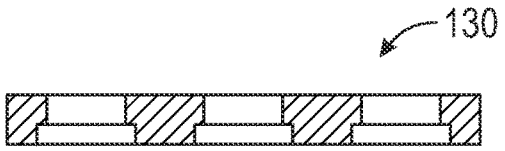
FIG. 11B illustrates a sectional view of the multiport nozzle plate shown in FIG. 11A in accordance with an embodiment.
Figure 11C:
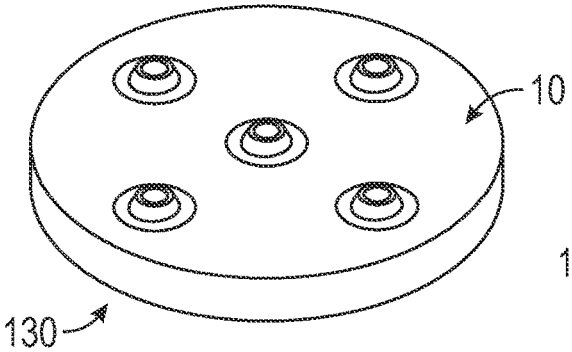
FIG. 11C illustrates a top perspective view of the multiport nozzle plate shown in FIG. 11A to 11B to in accordance with an embodiment.
Figure 11D:
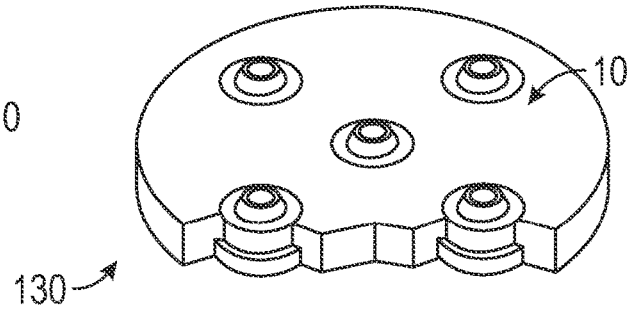
FIG. 11D illustrates a top sectional perspective view of the multiport nozzle plate shown in FIG. 11A to 11C to in accordance with an embodiment.
Figure 11E:
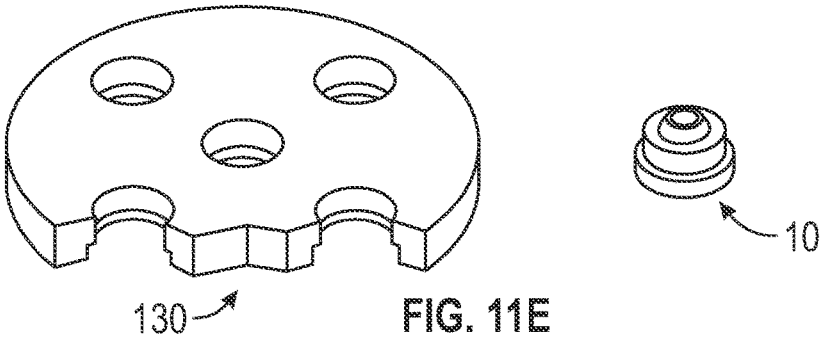
FIG. 11E illustrates a top perspective cut-away view of the multiport nozzle plate shown in FIG. 11A to 11D to in accordance with an embodiment.

FIG. 11A illustrates a top view and a sectional A-A view of a multiport nozzle plate 130, which may be implemented in accordance with an embodiment. FIG. 11B illustrates a sectional view of the multiport nozzle plate 130 shown in FIG. 11A in accordance with an embodiment. FIG. 11C illustrates a top perspective view of the multiport nozzle plate 130 shown in FIG. 11A to 11B to in accordance with an embodiment. FIG. 11D illustrates a top sectional perspective view of the multiport nozzle plate 130 shown in FIG. 11A to 11C to in accordance with an embodiment. FIG. 11E illustrates a top perspective cut-away view of the multiport nozzle plate 130 shown in FIG. 11A to 11D to in accordance with an embodiment. The multiport nozzle plate 130 can support the use of multiple burner nozzles such as burner nozzle 10 and a number of other such nozzles as depicted in FIG. 11A to 11E.

The embodiments disclosed herein represent a significant improvement in reducing the size and geometry limitations of various low emission combustion techniques used by industrial and commercial burner companies. In addition, these embodiments can allow for the creation of mixing geometries that were difficult, if not impossible, to create using conventional machining and fabrication processes. Additive manufacturing can allow for the application of all of these low emissions techniques in a single one-piece nozzle. This was not possible prior to the development of AM technology. The embodiments also utilize a unique trapped vortex flame stabilizing method, that eliminates the need for physical devices such as cones and swirlers, to be placed into the fuel-air stream to provide flame stabilization. This provides for reduced pressure drop through the burner and allows higher thermal inputs (BTU/hr or kw/hr) in a smaller device.

Based on the foregoing, it can be appreciated that a number of embodiments including preferred and alternative embodiments, are disclosed herein. For example, in an embodiment, a burner nozzle can include a main air/fuel port located centrally within the burner nozzle, a plurality of staged gas fuel ports that surrounds the main air-fuel port and which can direct fuel to an established flame zone downstream from the burner nozzle, and a trapped vortex chamber formed in a wall of the main air/fuel port and which can communicate with a plurality of primary gas ports in a fuel circuit, wherein the trapped vortex chamber facilitates flame stability with respect to a flame produced by the burner nozzle.

In an embodiment, the plurality of locations can include a primary zone wherein primary fuel can be mixed with air prior to ignition inside the trapped vortex chamber of the burner nozzle.

In an embodiment, the plurality of locations can include a location wherein ignition fuel aids ignition and the flame holding in the trapped vortex chamber.

In an embodiment, the plurality of locations can include a location where staged fuel can be injected downstream of the fuel ignited in a primary zone.

In an embodiment, the plurality of locations can include a primary zone wherein primary fuel is mixed with air prior to ignition inside the trapped vortex chamber of the burner nozzle, a location wherein ignition fuel aids ignition and the flame holding in the trapped vortex chamber, and a location where staged fuel can be injected downstream of the fuel ignited in the primary zone.

In an embodiment, after ignition inside the trapped vortex chamber of the burner nozzle the flame is stable and self-sustaining.

In an embodiment, each of the plurality of staged gas fuel ports can be sized to split a percentage of the fuel and direct the fuel into the staged flame zone downstream of a primary flame.

In an embodiment, a burner nozzle can include a plurality of staged gas fuel ports that surrounds a main air-fuel port and which directs fuel to an established flame zone downstream from the burner nozzle, and a trapped vortex chamber formed in the main air/fuel port and which can communicate with a plurality of primary gas ports in a fuel circuit, wherein the trapped vortex chamber facilitates flame stability with respect to a flame produced by the burner nozzle.

In an embodiment, a method of operating a burner nozzle, can involve: directing fuel with a plurality of staged gas fuel ports that surrounds a main air-fuel port to an established flame zone downstream from a burner nozzle, wherein the main air-fuel port is located centrally within the burner nozzle; an facilitating with a trapped vortex chamber, flame stability with respect to a flame produced by the burner nozzle, wherein the trapped vortex chamber is formed in a wall of the main air/fuel port and which communicates with a plurality of primary gas ports in a fuel circuit in the burner nozzle.

An embodiment of the method can involve mixing primary fuel with air in a primary zone among the plurality of locations, wherein the primary fuel is mixed with the air prior to ignition inside the trapped vortex chamber of the burner nozzle.

In an embodiment of the method, the plurality of locations can include a location wherein ignition fuel aids ignition and the flame holding in the trapped vortex chamber.

In an embodiment of the method, the plurality of locations can include a location where staged fuel is injected downstream of the fuel ignited in a primary zone.

In an embodiment of the method, each of the plurality of staged gas fuel ports can be sized to split a percentage of the fuel and direct the fuel into the staged flame zone downstream of a primary flame.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A burner nozzle, comprising:

a main body including at least a chamber base integrally coupled to a nozzle portion;

a main air/fuel port located centrally within the nozzle portion an air inlet located centrally within the chamber base and in fluid communication with the main air/fuel port for receiving a flow of air;

a primary fuel manifold formed in the chamber base for receiving a first portion of a total nozzle fuel flow, the primary fuel manifold in fluid communication with a plurality of main fuel outlet ports;

a staged fuel manifold formed in the chamber base for receiving a second portion of the total nozzle fuel flow, the staged fuel manifold in fluid communication with a plurality of staged fuel outlet ports that surround the main air/fuel port and which directs fuel to an established flame zone downstream from the burner nozzle; and a trapped vortex chamber formed in a wall of the main body and configured to facilitate flame stability with respect to a flame produced by the burner nozzle, wherein:

a first number of the main fuel outlet ports are located to discharge a first percentage of the first portion of the total nozzle fuel flow into the air inlet upstream of the trapped vortex chamber, and a second number of the main fuel outlet ports are located to discharge a second percentage the first portion of the total nozzle fuel flow into the trapped vortex generator.

2. The burner nozzle of claim 1, wherein after ignition inside the trapped vortex chamber of the burner nozzle the flame is stable and self-sustaining.

3. The burner nozzle of claim 1 wherein each of the plurality of staged gas fuel ports is sized to split a percentage of the fuel and direct the fuel into the staged established flame zone downstream of a primary flame.

4. The burner nozzle of claim 1, wherein:

the second portion of the total nozzle fuel flow is a third percentage of the total nozzle fuel flow; and the plurality of main fuel outlet ports and the plurality of staged fuel outlet ports are sized such that the first percentage, the second percentage, and the third percentage are unequal.

5. The burner nozzle of claim 4, wherein:

the first percentage is greater than the second percentage and less than the third percentage; and the second percentage is less than the third percentage are unequal.

6. The burner nozzle of claim 5, wherein:

the first percentage, the second percentage, and the third percentage are 29%, 1%, and 70%, respectively.

7. A multi-port burner nozzle assembly, comprising:

a multi-nozzle plate having a plurality of burner nozzle openings formed therein; and a plurality of burner nozzles, each burner nozzle disposed within a different one of the burner nozzle openings, each burner nozzle comprising:

a main body including at least a chamber base integrally coupled to a nozzle portion;

a main air/fuel port located centrally within the nozzle portion an air inlet located centrally within the chamber base and in fluid communication with the main air/fuel port for receiving a flow of air;

a primary fuel manifold formed in the chamber base for receiving a first portion of a total nozzle fuel flow, the primary fuel manifold in fluid communication with a plurality of main fuel outlet ports;

a staged fuel manifold formed in the chamber base for receiving a second portion of the total nozzle fuel flow, the staged fuel manifold in fluid communication with a plurality of staged fuel outlet ports that surround the main air/fuel port and which directs fuel to an established flame zone downstream from the burner nozzle; and a trapped vortex chamber formed in a wall of the main body and configured to facilitate flame stability with respect to a flame produced by the burner nozzle, wherein:

a first number of the main fuel outlet ports are located to discharge a first percentage of the first portion of the total nozzle fuel flow into the air inlet upstream of the trapped vortex chamber, and a second number of the main fuel outlet ports are located to discharge a second percentage the first portion of the total nozzle fuel flow into the trapped vortex generator.

8. The assembly of claim 7, wherein:

the second portion of the total nozzle fuel flow is a third percentage of the total nozzle fuel flow; and the plurality of main fuel outlet ports and the plurality of staged fuel outlet ports are sized such that the first percentage, the second percentage, and the third percentage are unequal.

9. The assembly of claim 8, wherein:

the first percentage is greater than the second percentage and less than the third percentage; and the second percentage is less than the third percentage are unequal.

* * * * *